United States Patent [19]

Granger

[11] Patent Number: 4,715,901

[45] Date of Patent: Dec. 29, 1987

[54] ARCHITECTURAL PRODUCT

[75] Inventor: Douglas A. Granger, Murrysville, Pa.

[73] Assignee: Aluminum Company of America, Pittsburgh, Pa.

[21] Appl. No.: 776,934

[22] Filed: Sep. 17, 1985

Related U.S. Application Data

[63] Continuation of Ser. No. 533,348, Sep. 19, 1983, abandoned.

[51] Int. Cl.[4] ..... C22F 1/04

[52] U.S. Cl. ..... 148/2; 148/11.5 A; 148/400; 148/437; 148/438; 148/439; 148/440; 204/33; 204/58

[58] Field of Search ..... 420/528, 534, 535, 537, 420/543–548; 148/2, 11.5 A, 31.5, 415–418, 437–440; 204/33, 58

[56] References Cited

PUBLICATIONS

Alloy Digest, Aluminum 1100, Feb. 1974, Engineering Alloys Digest Inc., Upper Montclair, N.J.

Alloy Digest, Aluminum 5005, Nov. 1978, Engineering Alloys Digest Inc., Upper Montclair, N.J.

Aluminum Standards and Data, Third Edition, Jan. 1972, pp. 13, Aluminum Association.

*Primary Examiner*—R. Dean

*Attorney, Agent, or Firm*—Carl R. Lippert

[57] ABSTRACT

Structural streaking defects in anodized aluminum architectural sheet products are substantially reduced or eliminated in 1XXX and 5XXX type aluminum alloys by including therein 0.01 to 0.08% of chromium or manganese, preferably both. It is preferred to combine such with continuously casting the ingot under high chill rate conditions such as employing low liquid metal head within the direct chill mold.

32 Claims, No Drawings

ARCHITECTURAL PRODUCT

This is a continuation of application Ser. No. 533,348, filed Sept. 19, 1983 abandoned.

BACKGROUND OF THE INVENTION

This invention relates to the provision of improved architectural sheet products, particularly products which are anodized and to methods of producing such.

Architectural aluminum sheet products have enjoyed substantial commercial success and are readily observed covering many large high-rise buildings. One popular method of treatment applied to these products is anodizing in an acidic electrolyte to provide a durable, decorative anodized coating. Aluminum alloy products in alloys 1100 and 5005 have seen wide use in this application because of modest cost, good formability, adequate strength, good rolling and mill finishing properties and desirable response to anodizing treatments.

However, one problem in these alloys and similar alloys involve the formation of bands of inconsistent color or texture appearing along the length of the anodized sheet usually at certain regions across its width. This condition, a rejectable defect, is sometimes referred to as a "tiger stripe" defect and speaking more technically, is often referred to as structural streaking and is apparently caused by inconsistent or non-homogeneous distribution of ingredients or phases across the width of the sheet. Homogenizing treatments and other treatments performed after casting are not effective to cure this problem, although some improvements have been achieved through better control of the casting operation such as better grain refinement and the use of low molten metal levels in continuous casting molds, often referred to as low head casting, which achieves very high ingot surface region chill rates. Still another casting improvement lies in electromagnetic casting. However, there remains substantial room for improvement in this important application in that rejections for structural streaking defects still persist.

The objectionable condition is aesthetic rather than genuinely structural, and like other aesthetic defects, the condition is objectionable simply because it looks objectionable. If sheet products are rolled thin enough, for instance less than 0.015 or 0.02 inch thick, to elongate the condition over more surface, the degree of streaking defects appears to lessen. However, for relatively thick sheet of over 0.03 or 0.04 inch, the structural streaking problem persists and it is thick sheet of about 0.04 to 0.15 or 0.25 inch which is usually needed for architectural applications.

SUMMARY OF THE INVENTION

In accordance with the invention, it has been found that the inclusion of relatively small, but effective, amounts of manganese or chromium, preferably both, can substantially eliminate structural streaking problems in 1XXX type aluminum alloys and especially in 5XXX aluminum alloys. The additions are from 0.01 to 0.08% of manganese and chromium and substantially eliminate the structural streaking problem referred to without adversely affecting the desirable color response of the alloy in anodizing treatments. All percentages herein for alloy composition are by weight.

DETAILED DESCRIPTION

One explanation for the structural streaking problem lies in the presence of iron or silicon which are beneficial as color or texture enhancers in anodized aluminum products, but which unfortunately tend to distribute themselves in a non-uniform fashion in continuously cast ingots, especially ingots having a width-to-thickness ratio of greater than 2, for instance a width-to-thickness ratio of 2½ or 3:1 and a thickness over 6 inches.

In these ingots, a pattern of structural streaking occurs often corresponding to the 25 and 75% points across the ingot width (about one-fourth in from each lateral edge) despite the use of careful casting techniques. The condition appears to be caused by inconsistent size, distribution and phaseology of dispersed phases containing iron, silicon and aluminum. When sheet or plate is rolled from ingot containing such an inconsistent distribution pattern, that pattern is carried over into the rolled sheet or plate product after anodizing. The pattern is manifested as the structural streaking problem which appears as bands of anodized color or texture discontinuity corresponding generally to the same quarter-point locations across the ingot width.

In discussing the phaseology of these alloys with respect to the iron-aluminum-silicon phases, three prominent phases are the stable $Al_3Fe$ phase and the metastable $Al_6Fe$ and $Al_mFe$ phase, "m" being a value greater than 3 and less than 6. The $Al_mFe$ phase is much more desirable from an anodizing standpoint. Generally, the ingot along the length of the rolling surface has an as-cast distribution pattern sometimes referred to as a fir tree pattern wherein the ingot throughout its central cross-section is richer in the $Al_3Fe$ phase, which structure extends toward the cast surface where more $Al_mFe$ phase is found. When viewed in cross-section along an ingot length and across its thickness, a saw-tooth pattern with $Al_3Fe$ saw-tooth points reaching toward the surface region and $Al_6Fe$ generally filling in between the $Al_3Fe$ saw-teeth establish the "fir tree" pattern. A surface band of varying thickness containing $Al_mFe$ prevails outside the regions of the other phases. Ingot intended for anodized products is scalped to remove surface roughness and it is the scalped surface which is rolled and the resulting rolled surface anodized. Hence, the scalped surface is very important, and the presence of large bands of $Al_3Fe$ or $Al_6Fe$ at the scalped surface is considered a major cause of the structural streaking problem. However, the scalping, typically about one-half to three-fourths inch deep, removes substantial portions of the desirable $Al_mFe$ surface phase and increases the likelihood of encountering patches of the $Al_6Fe$ and $Al_3Fe$ phases and their attendant structural streaking effect.

The presence of the $Al_3Fe$ phase in bands in rolled products gives rise to the broad, light-etching and classic "tiger stripe" structural streaking effect. When present, the $Al_6Fe$ phase gives rise to similar, but dark-etching stripes. It has been suggested that use of high temperature preheat or homogenizing treatments could effect achieving a single iron-bearing phase, specifically $Al_3Fe$ by breakdown of the metastable $Al_mFe$ and $Al_6Fe$ phases. However, such a condition often results in unacceptably high glossiness and a highly non-uniform distribution of the $Al_3Fe$ phase. Low head DC casting should result in a single phase, $Al_mFe$, but unfortunately at the quarter-point locations the other phases, $Al_6Fe$ and $Al_3Fe$ often persist. One structural streaking defect appears as one or more bands of lighter coloration than the background and is caused by any significant presence of $Al_3Fe$. Another structural streaking defect appears as darker stripes and is caused by breakdown of the $Al_6Fe$ phase referred to above. These defects are brought out by etching or anodizing and are magnified when both are employed which is the usual condition in architectural applications. One explanation for the beneficial effect of the chromium and manganese additions in accordance with the invention is that they may broaden the freezing rate range over which $Al_mFe$ can be formed such that its formation is favored extending a substantial depth from the surface such that even the scalped surface is rich in $Al_mFe$ and very lean in the other Fe phases discussed.

As stated earlier, it has been found that the inconsistent anodizing response referred to above can be eliminated or very substantially reduced in alloys of the 1XXX and 5XXX type by including therein relatively small but nonetheless effective amounts of manganese or chromium. Chromium is more effective than manganese and both are still more effective. The amounts of these elements included in accordance with the invention range from a minimum of about 0.005 or 0.01%, preferably a minimum of 0.02%, up to a maximum of about 0.07 or 0.08%, preferably a maximum of about 0.06%. A preferred range for chromium and manganese is a range of about 0.02 to 0.05 or 0.06% each, which has been found to result in anodized coating lightness, gloss and color rating which are very desirable for the particular types of alloys concerned. The addition of chromium alone in the amounts stated substantially improves anodizing, but adding of manganese with the chromium is preferred as imparting still greater benefits. It is believed that one or more of the following elements can be substituted in the amounts stated for Mn and possibly Cr: nickel, zirconium, vanadium, cobalt, molybdenum and the rare earth metals (Lanthanide series from Period 6 of the Periodic Table) such as cerium or Misch metal. The total amount of such elements preferably does not exceed 0.5 or 0.6%. For instance V or Co may be helpful but are somewhat expensive.

An important aspect of the invention is that the basic or general anodizing response of the 1XXX or 5XXX alloy is substantially unchanged by these additions, except for elimination of the streaking defect. That is, in the specific amounts herein employed, the Cr and Mn additions are effective to eliminate the streaking defect without introducing undesirable color or texture characteristics of their own. Exceeding the herein set forth limits for these elements, however, can introduce undesired color or texture characteristics.

The general classes of alloys to which the invention most applies are those designated as 1XXX alloys and 5XXX alloys under the Aluminum Association (AA) system. In referring to Aluminum Association alloys, 1XXX type alloys under present practice generally refer to alloys containing at least 98.5 or 99% aluminum without any substantial amount, not more than 0.25% of any one of the alloying additions, such as Mg, Cu, Zn or Mn, normally employed in aluminum, although significant amounts (even up to about 1% total) of iron and silicon may be present as impurities. One such alloy is Alloy 1100 whose sales limits specify 1% total for Fe plus Si, 0.05 to 0.2% copper, maximum of 0.05% for Mn and 0.10% for Zn with other elements being limited to 0.05% each, 0.15% total. 5XXX alloys are those aluminum alloys containing magnesium as their major addition to the aluminum base. An example is Alloy 5005 whose sales limits specify 0.5 to 1.1% Mg and maximums of 0.30% for Si, 0.7% for Fe, 0.2% for Cu, 0.2% for Mn, 0.10% for Cr, 0.25% for Zn with other elements limited to 0.05% each, 0.15% total.

Of the above-mentioned alloys, the invention is particularly suited to Alloy 5005 containing about ½ to 1.1% Mg, which is a widely employed architectural sheet aluminum alloy enjoying very substantial commercial success, but which is marked by the structural streaking problem. The invention is also suited to other 5XXX alloys containing magnesium as the dominant alloying addition in minimum amounts of 0.3 or 0.4% Mg, preferably at least 0.45 or 0.5% Mg, and maximum amounts of 1.5 or 2% Mg or as high as 2.5% Mg.

The improved 5XXX alloys typically contain other elements including iron, typically greater than 0.25 or 0.3%, typically 0.4 or 0.5% Fe, but not exceeding 0.9 or 1% Fe, preferably not exceeding 0.6 or 0.7%. A suitable range for Fe in a 5XXX alloy in accordance with the present invention is about 0.3 or 0.35% to about 0.55 or 0.6% Fe. Silicon is also present, typically in amounts greater than 0.05 or 0.1% Si, but not exceeding 0.4 or 0.5% Si, preferably not exceeding 0.3% Si. Suitable ranges for Si in 5XXX alloys in accordance with the present invention are about 0.05 or 0.07% to about 0.15% or 0.2% or even 0.25% Si. While iron and silicon are normally considered impurities in 5XXX alloys, they are recognized in the art as beneficial in architectural sheet products which are anodized since Fe and Si contribute some to etched and anodized response and are preferably present in the herein-designated ranges. The improved 5XXX alloys may also contain other elements sometimes present in 5XXX alloys such as small amounts of copper, 0.02 to 0.25 or 0.3% Cu, preferably 0.05 to 0.15% Cu, where Cu is present. Other elements can be included as impurities or as additions so long as they do not disturb the effect and operation of the improvement. Such elements include 0.005 to 0.05% Ti, 0.001 to 0.02% B, for their known grain refining effects and any of the other elements normally associated with architectural aluminum alloy products.

Typical and preferred 5XXX alloys are set forth as Alloys 1 and 2 in Table I.

TABLE I

| Alloy | Mg | Fe | Si | Cr | Mn | Cu |
|---|---|---|---|---|---|---|
| 1 | 0.4–1.8 | 0.3–0.6 | 0.1–0.25 | 0.02–0.07 | 0.02–0.07 | 0.2 max. |
| 2 | 0.6–0.9 | 0.3–0.6 | 0.05–0.15 | 0.02–0.05 | 0.02–0.05 | 0.05–0.1 |
| 3 | | 0.35–0.55 | 0.05–0.1 | 0.02–0.04 | 0.02–0.04 | 0.05–0.2 |
| 4 | | 0.35–0.55 | 0.2–0.3 | 0.02–0.05 | 0.02–0.05 | — |

The improved 1XXX alloys in accordance with the present invention contain at least 98 or 98.5% aluminum, preferably at least 99% aluminum. As with 5XXX alloys, iron and silicon are normally considered impurities in 1XXX alloys, but are herein intentionally present in controlled amounts because of their known beneficial effect in etching and anodizing. Iron is present in the improved 1XXX alloys in minimum amounts of 0.25 or 0.3%, typically 0.4 or 0.5% Fe. The iron should not exceed 0.8 or 0.9%, typically not over 0.6 or 0.7% Fe. A maximum for iron is 1%. A suitable iron range is 0.3 or 0.35% to 0.55 or 0.6% Fe. Silicon is typically present in amounts less than the iron, but at least 0.05 or 0.1%, typically at least 0.15 or 0.2% Si. Silicon does not exceed 0.3 or 0.4%. A suitable range for Si is 0.1 to 0.2% Si. The improved 1XXX type alloys may also contain other elements such as up to 0.3% Cu or 0.05 to 0.25% Cu. As with the improved 5XXX alloys, other elements can be included as impurities or as additions so long as they do not disturb the effect and operation of the improvement although elements other than Al, Fe and Si do not exceed 0.25 or 0.3% each.

Typical 1XXX alloys in accordance with the invention are set forth as Alloys 3 and 4 in Table I.

In formulating alloys in accordance with the invention, scrap may be utilized as is often done in the aluminum industry. The iron and silicon can be adjusted, but such might not be necessary as these elements are often present as impurities. The composition is adjusted with respect to the Cr, Mn or other metal additives in accordance with the invention, typically by adding such to the alloy melt.

It is advantageous in practicing the invention to employ a continuous casting of the alloy wherein molten metal is introduced to the entrance end of an open-ended mold and an ingot with at least its surface portion solidified is withdrawn from the exit end and wherein the depth of molten metal above the exit end of the mold is relatively small, for instance less than 2 inches from the mold exit such as about 1 inch from the mold exit. This type of casting is sometimes referred to as low head casting and is described in a number of publications such as U.S. Pat. Nos. 3,425,482 and 4,016,924, incorporated herein by reference, which disclose methods for using low head casting combined with initiating the casting run with a deeper molten metal pool. Insofar as the advantages of low head casting in practicing the invention are concerned, what is important is operating at the low head quite independent from whether the casting run is initiated under high head or low head conditions. A preferred practice of the invention includes initiating and operating substantially at all times under low head casting conditions. This use of low head casting favors uniform high chill rates of about 4° or 5° to 18° or 20° F. per second at the ingot surface which, in turn, favor formation of $Al_mFe$ phase in the ingot surface region and extending significantly into the ingot, which extension is substantially increased by the present invention. The ingots cast are typically well over 6 inches thick, for instance over 10 inches thick, typically 18 or 20 inches or more in thickness.

After the ingot is cast, it is scalped to provide a suitable good surface for rolling which, in turn, should facilitate a superior as-rolled surface to provide for a good result after anodizing. In practicing the invention it is found that Guinier X-Ray diffraction analysis of the surface after scalping reveals substantially all of the iron present as $Al_mFe$ and little, if any, present as $Al_3Fe$ or other phases, and further observations show that the detrimental effect of these phases is alleviated. A possibly even more sensitive test, anodizing, further verifies the substantial absence of Fe-bearing phases other than $Al_mFe$ in that substantial freedom from structural streaking is observed in etched and anodized scalped surface samples.

After scalping, the ingots are normally homogenized or preheated. This typically includes heating the metal to a temperature within the range of about 700° to about 900° or possibly 950° F. Higher preheat temperatures are disadvantageous in practicing the invention. A preferred temperature is about 700° or 750° F. to about 825° or 850° F.

The ingot is then rolled into the sheet product of desired thickness. Rolling can be effected by hot rolling in a reversing mill followed by hot continuous rolling which, in turn, can be followed by cold rolling with or without intermediate anneals between hot rolling and cold rolling or at stages within the cold rolling operation. The cold rolling operations can be scheduled in conjunction with annealing operations to produce desired or required tempers in accordance with practices known in the art. Common tempers for architectural products include the H11, H112, H14 and H34 strain-hardened tempers. The thickness for the improved architectural products ranges from about 0.02 or 0.025 inch to about 0.25 inch, typically 0.03 or 0.04 to 0.15 inch.

As is known, aluminum alloys can be anodized in a number of acidic electrolytes to produce desired clear or integrally colored anodic coatings. One such treatment includes anodizing in an aqueous bath containing about 100 to 200 grams per liter $H_2SO_4$ at a temperature of about 70° to 90° F. and a current density of from about 6 to 36 amperes per square foot. Anodizing time can vary from about 20 to 80 minutes, and the coating can vary from about 0.7 to 1.2 mils in thickness. Suitable acids include sulfuric acids, oxalic acids and sulfonic acids, such as sulfosalicylic acid, sulphothalic acid or sulfosuccinic acid. It is usually desirable to seal the anodic coating for example by immersing in hot (210° F.) water or other suitable solutions.

The coloration and texture developed in the anodic treatment can be influenced by treatment of the sheet prior to anodic oxidation. The surface can be chemically brightened by washing with a solution of phosphoric and nitric acids or electrochemical procedures. Mechanical treatment such as buffing, polishing, sandblasting and others can be employed to alter the texture of the surface prior to anodizing. All these practices are generally recognized in the art. One suitable practice is to caustically etch the surface which results in a low gloss, or light-looking matte surface. In anodizing 5005 type alloy in the sulfuric acid electrolyte as described, the sheet exhibits a clear or generally transparent finish to highlight the matte metallic aluminum substrate produced by caustic etching. This condition is recognized as extremely attractive except for the previous structural streaking problem now alleviated by the practice of the invention.

EXAMPLE

To illustrate the improvement, 5005-type prior art Alloy A was processed into architectural sheet products and improved products according to the invention likewise processed for comparison. The representative prior art 5005 Alloy A composition is set forth in Table II along with the composition range B for an addition of Mn and range C for over 10 ingots made in accordance with the improvement including both Cr and Mn. Elements other than those specified were limited to 0.05% maximum each, 0.15% maximum total.

TABLE II

| Alloy | Si | Fe | Mg | Cr | Mn | Cu | Ti |
|---|---|---|---|---|---|---|---|
| A | 0.10 | 0.47 | 0.68 | 0.001 | 0.002 | 0.08 | 0.015 |

TABLE II-continued

| Alloy | Si | Fe | Mg | Cr | Mn | Cu | Ti |
|---|---|---|---|---|---|---|---|
| B | 0.11 | 0.43 | 0.73 | 0.002 | 0.039 | 0.07 | 0.028 |
| C | 0.7–0.13 | 0.35–0.55 | 0.65–0.80 | 0.02–0.04 | 0.02–0.04 | 0.05–0.1 | 0.01–0.05 |

The alloys were all semi-continuously direct chill cast into large ingots about 20 inches thick by 54 or 55 inches wide using low head high chill rate casting procedures. The ingots were scalped ⅝ inch on each rolling face and then preheated for around 10 hours typical soak at about 825° F. The ingots were hot rolled at an entry temperature of about 800° F. to a thickness of about 0.15 or 0.16 inch and cold rolled to sheet about 0.090 inch thick. The sheet was caustic etched in a 5% NaOH aqueous solution at about 125° F. and anodized in a sulfuric acid electrolyte to produce a matte aluminum color covered by a clear anodic coating.

The sheets made from Alloy A representative of prior art 5005 alloy exhibited a substantial amount of structural streaking at the quarter-width points. The Alloy B sheet was significantly improved, but still showed some barely perceptible minor streaking. The sheet made from improved Alloy C, however, was completely streak-free, thus clearly demonstrating the improvement with the preferred alloy containing both Cr and Mn. Other tests show that the performance of Cr as the lone additive is almost as good as Cr plus Mn, but is slightly less consistent than the preferred embodiment containing both Cr and Mn.

From the foregoing it can be seen that the present improvement includes aluminum alloys containing small, but effective additions of chromium or manganese, preferably both, or other metal additives hereinbefore set forth and improved aluminum sheet or plate products made from such alloys including anodized aluminum sheet products and including methods for producing the same including casting ingots of such alloys, scalping and rolling the ingot into the improved sheet products or even possibly directly casting the sheet products continuously. The improved sheet products exhibit substantial freedom from the structural streaking defect previously experienced.

While the invention has been described in terms of preferred embodiments, the claims appended hereto are intended to encompass all embodiments which fall within the spirit of the invention.

What is claimed is:

1. The method of producing an improved aluminum sheet product having substantial freedom from structural streaking in an electrochemically or chemically treated condition, said method comprising:

(1) formulating an aluminum base alloy consisting essentially of:

(a) at least 98.5% aluminum, 0.25 to 1% Fe, 0.05 to 0.4% Si, not more than 0.3% of any other element except aluminum; or (b) 0.3 to 2.5% Mg, 0.25 to 1% Fe, 0.05 to 0.5% Si said formulating including the step of adding one or more metal additives from the group consisting of Cr, Mn, Ni, Zr, V, Co, Mo and the rare earth elements so as to include in said alloy 0.01 to 0.08% each for one or more of such elements so added but not more than 0.2% combined total for all such elements, the balance of said alloy being aluminum and incidental elements and impurities;

(2) casting an ingot of said alloy; and (3) producing said sheet from said ingot.

2. The method according to claim 1 wherein said alloy contains 0.02 to 0.06% Cr.

3. The method according to claim 1 wherein said alloy contains 0.02 to 0.06% each of Cr and Mn.

4. The method according to claim 1 wherein said production of sheet includes direct chill casting at a surface chill rate of at least 4° F. per second.

5. The method according to claim 1 wherein said sheet is etched to develop a matte surface and anodized to provide an anodic coating over a matte substrate.

6. The method according to claim 1 wherein said additive is selected from the group consisting of Ni, Zr, V, Co, Mo and the rare earth elements.

7. The method according to claim 6 wherein said additive is cerium.

8. The method according to claim 6 wherein said additive is zirconium.

9. The method according to claim 6 wherein said additive is nickel.

10. The method according to claim 6 wherein said additive is vanadium.

11. A method of producing an improved aluminum sheet product comprising:

(1) formulating an aluminum base alloy consisting essentially of:

(a) at least 98.5% aluminum, 0.25 to 1% Fe, 0.05 to 0.4% Si, not more than 0.3% of any other element except aluminum; or (b) 0.3 to 2.5% Mg, 0.25 to 1% Fe, 0.05 to 0.5% Si; said formulating including the step of adding one or more metal additives from the group consisting of Cr, Mn, Ni, Zr, V, Co, Mo and the rare earth elements so as to include in said alloy 0.01 to 0.08% each for one or more of such elements so added but not more than 0.2% combined total for all such elements, the balance of said alloy being aluminum and incidental elements and impurities;

(2) continuously casting an ingot at least 6 inches thick of said alloy under low head conditions wherein the liquid metal level in the casting device is not more than two inches from the exit of the casting device and the surface chill rate of the solidifying ingot is 4° to 20° F. per second;

(3) scalping said ingot to provide scalped surfaces suitable for rolling said metal additive favoring during said casting the formation of $Al_mFe$ in the surface region and extending into said ingot a substantial distance such that the scalped ingot surface exhibits its iron and silicon phase substantially as $Al_mFe$; and (4) rolling said ingot to produce a sheet product about 0.03 to 0.25 inch thick;

said product being characterized by the ability to be anodized in an acidic electrolyte to develop an integral anodic oxide coating substantially free from structural streaking.

12. The method according to claim 11 wherein said alloy contains 0.02 to 0.06% Cr.

13. The method according to claim 11 wherein said alloy contains 0.02 to 0.06% each of Cr and Mn.

14. The method according to claim 11 wherein said sheet is etched to develop of matte surface and anodized to provide a substantially clear anodic coating over a matte substrate.

15. In a method of producing an anodized aluminum sheet product wherein an aluminum base alloy sheet is anodized to coat it with an integrally bonded anodic coating, the improvement which substantially alleviates structural streaking defects in said anodized product comprising:

(1) formulating an aluminum base alloy consisting essentially of:

(a) at least 98.5% aluminum, 0.25 to 1% Fe, 0.05 to 0.4% Si, not more than 0.3% of any other element except aluminum; or (b) 0.3 to 2.5% Mg, 0.25 to 1% Fe, 0.05 to 0.5% Si; said formulating including the step of adding one or more metal additives from the group consisting of Cr, Mn, Ni, Zr, V, Co, Mo and the rare earth elements so as to include in said alloy 0.01 to 0.08% each for one or more of such elements so added but not more than 0.2% combined total for all such elements, the balance of said alloy being aluminum and incidental elements and impurities;

(2) continuously casting said alloy under rapid chill conditions to produce an elongate solidified alloy body, said metal additive favoring during said casting the formation of $Al_mFe$ in the surface region and extending a substantial distance into said body;

said anodized sheet product being substantially free from structural streaking.

16. The method according to claim 15 wherein said alloy contains 0.02 to 0.06% Cr.

17. The method according to claim 15 wherein said alloy contains 0.02 to 0.06% each of Cr and Mn.

18. The method according to claim 15 wherein said production of sheet includes direct chill casting at a surface chill rate of at least 4° F. per second.

19. The method according to claim 15 wherein said sheet is etched to develop a matte surface and anodized to provide a substantially clear anodic coating over a matte substrate.

20. In a method of producing an anodized aluminum sheet product wherein an aluminum sheet product is etched to provide a matte surface and said surface is anodized to coat it with an integrally bonded anodic coating, the improvement which substantially alleviates structural streaking in said anodized product comprising:

(1) formulating an aluminum base alloy consisting essentially of:

(a) at least 98.5% aluminum, 0.25 to 1% Fe, 0.05 to 0.4% Si, not more than 0.3% of any other element except aluminum; or (b) 0.3 to 2.5% Mg, 0.25 to 1% Fe, 0.05 to 0.5% Si; said formulating including the step of adding one or more metal additives from the group consisting of Cr, Mn, Ni, Zr, V, Co, Mo and the rare earth elements so as to include in said alloy 0.01 to 0.08% each for one or more of such elements so added but not more than 0.2% combined total for all such elements, the balance of said alloy being aluminum and incidental elements and impurities;

(2) continuously casting an ingot at least 6 inches thick of said alloy under low head conditions wherein the liquid metal level in the casting device is not more than two inches from the exit of the casting device and the surface chill rate of the solidifying ingot is 4° to 20° F. per second;

(3) scalping said ingot to provide scalped surfaces suitable for rolling said metal additive favoring during said casting the formation of $Al_mFe$ in the surface region and extending into said ingot a substantial distance such that the scalped ingot surface exhibits its iron and silicon phase substantially as $Al_mFe$ across its rolling surfaces; and (4) rolling said ingot to produce a sheet product.

21. Improved aluminum sheet or plate product composed of an aluminum base alloy consisting essentially of:

(a) at least 98.5% aluminum, 0.25 to 1% Fe, 0.05 to 0.4% Si, not more than 0.3% of any other element except aluminum; or (b) 0.3 to 2.5% Mg, 0.25 to 1% Fe, 0.05 to 0.5% Si, said alloy further including as an addition thereto one or more metals from the group consisting of Cr, Mn, Ni, Zr, V, Co, Mo and the rare earth elements said metals being present in said aluminum base alloy in a total amount of 0.02 to 0.08% each but not more than 0.2% total for all said metals, the balance of said alloy being aluminum and incidental elements and impurities;

said product, when in a condition resulting from operations comprising continuous casting and electrochemical or chemical surface treatment exhibiting a surface substantially free from structural streaking.

22. The improvement according to claim 21 wherein the amount of iron exceeds that of silicon in said alloy.

23. The improvement according to claim 21 wherein said alloy contains 0.45 to 1.5% Mg, 0.3 to 0.6% Fe, 0.05 to 0.2% Si and 0.02 to 0.06% each of Cr and Mn.

24. The improvement according to claim 21 wherein said alloy contains at least 99% Al, 0.3 to 0.6% Fe, 0.05 to 0.2% Si, 0.05 to 0.25% Cu, and 0.02 to 0.06% each of Cr and Mn, and not more than 0.3% of any other element except aluminum.

25. The improvement according to claim 21 wherein said product is 0.03 to 0.15 inch thick.

26. The improvement according to claim 23 wherein said alloy contains 0.05 to 0.25% Cu.

27. The improvement according to claim 21 wherein said product is in the anodized condition.

28. The improvement according to claim 21 wherein said additive is selected from the group consisting of Ni, Zr, V, Co, Mo and the rare earth elements.

29. The improvement according to claim 21 wherein said additive is cerium.

30. The improvement according to claim 21 wherein said additive is zirconium.

31. The improvement according to claim 21 wherein said additive is nickel.

32. The method according to claim 21 wherein said additive is vanadium.

* * * * *